US010344543B2

(12) United States Patent
Carfi et al.

(10) Patent No.: US 10,344,543 B2
(45) Date of Patent: Jul. 9, 2019

(54) DEVICE FOR SECURING AND CATCHING A CABLE IN AN OIL WELL

(71) Applicant: YPF TECNOLOGIA S.A., Ciudad Autónoma de Buenos Aires (AR)

(72) Inventors: Guillermo Rodolfo Carfi, Ciudad Autónoma de Buenos Aires (AR); Juan Martinez Sanchez, Ciudad Autónoma de Buenos Aires (AR); Luis Alberto Aguirre, Ciudad Autónoma de Buenos Aires (AR)

(73) Assignee: YPF TECNOLOGIA S.A., Ciudad Autónoma de Buenos Aires (AR)

( * ) Notice: Subject to any disclaimer, the term of this patent is extended or adjusted under 35 U.S.C. 154(b) by 95 days.

(21) Appl. No.: 15/364,879

(22) Filed: Nov. 30, 2016

(65) Prior Publication Data

US 2017/0152717 A1 Jun. 1, 2017

(30) Foreign Application Priority Data

Nov. 30, 2015 (AR) ..... 20150103909

(51) Int. Cl.
*E21B 19/10* (2006.01)
*E21B 40/00* (2006.01)

(52) U.S. Cl.
CPC ..... *E21B 19/10* (2013.01); *E21B 40/00* (2013.01)

(58) Field of Classification Search
CPC ..... E21B 19/10; E21B 33/0422; E21B 40/00
See application file for complete search history.

(56) References Cited

U.S. PATENT DOCUMENTS 2,570,080 A * 10/1951 Stone ..... E21B 19/10 173/164
2,623,257 A * 12/1952 Moon ..... E21B 19/10 188/67

(Continued)

*Primary Examiner* — Matthew R Buck
(74) *Attorney, Agent, or Firm* — Muncy, Geissler, Olds & Lowe, P.C.

(57) ABSTRACT

A security device placed at a wellhead over a blowout preventer valve, which can be activated to catch a cable and/or a string of pipes upon a cut event or accident, preventing the fall of the same into the well, which includes: an upper horizontal plate and lower horizontal plate, vertically aligned, each having a circular central orifice for the passing of a string of pipes and/or a cable, and a cutout on the front part thereof, located between its front edge and the circular orifice; lateral support device, located between the upper and lower plates, that connect the plates together, delimiting an aperture at the front part of the device that together with the cutouts on the upper and lower plates form a front passage toward the inside of the device; at least two clamps driven by corresponding hydraulic cylinders, which are arranged at an acute angle with the vertical axis of the device; and a movable vertical plate arranged on the front part of the device between the lateral support means, pivotally connected by one of its sides to the upper and lower plates. The movable vertical plate, in a first position, allows for the horizontal passing of a string of pipes and/or cables through the front passage to a location at the center of the device, and in a second position, the movable vertical plate blocks the front passage. In a first position the clamps allow for vertical movement of the string of pipes and or cables and in a second position the clamps block the movement of the same.

5 Claims, 6 Drawing Sheets

(56) References Cited

U.S. PATENT DOCUMENTS

| | | | | | |
|---|---|---|---|---|---|
| 3,457,605 | A * | 7/1969 | Kingsbury | E21B 3/04 | 175/195 |
| 3,467,224 | A | 9/1969 | Curtis et al. | | |
| 4,275,487 | A * | 6/1981 | Gray | E21B 19/10 | 188/67 |
| 4,372,706 | A | 2/1983 | Young | | |
| 4,498,563 | A | 2/1985 | Trahan | | |
| 4,715,625 | A * | 12/1987 | Shows, Jr. | E21B 19/10 | 188/67 |
| RE32,642 | E * | 4/1988 | Boudreaux | E21B 43/08 | 166/380 |
| 6,394,201 | B1 * | 5/2002 | Feigel, Jr. | E21B 10/00 | 166/75.14 |
| 7,703,540 | B2 * | 4/2010 | Webre | E21B 17/026 | 166/379 |
| 7,980,298 | B2 * | 7/2011 | Halse | E21B 19/10 | 166/75.14 |
| 9,181,763 | B2 * | 11/2015 | McIntosh | E21B 19/10 | |
| 2012/0048535 | A1 * | 3/2012 | Ruttley | E21B 19/00 | 166/85.1 |

* cited by examiner

DEVICE FOR SECURING AND CATCHING A CABLE IN AN OIL WELL

FIELD OF THE INVENTION

The present invention refers to a device for securing and catching a cable in an oil well, hereby designated as a "cable-catcher". More specifically, the present invention refers to a device to be placed on a wellhead over a blowout preventer valve (BOP) which can be activated to catch a cable and/or string of pipes upon an accident or cut event, preventing the fall of the same into the well.

BACKGROUND OF THE INVENTION

Generally, the processes of exploitation, exploration and/or intervention in an oil well involve the controlled descent or ascent of hanging intervention equipment, tools and/or tubular elements to and from the interior of the well. Said intervention equipment is hung inside the well and its position is controlled by an elevation and descent system which comprises a set of cables, a set of pulleys or rig (also known as traveling block) and a reel (also known as drawworks). Said elevation and descent system is designed to, under normal operation conditions, support the entire height of all the equipment and the string of pipes.

However, there exists the possibility of a failure event or accident occurring in one or more components of said elevation and descent system. This may be a human or a mechanical failure in some of the components of the elevation and descent system, such as a cable cut, failure of the reel breaking system, detachment or breakage of one of the components, etc. Upon an event such as this one, it is possible that the elevation and descent system will be incapable of supporting the weight of the hung elements, and that they will descend in free-fall toward the inside of the well, potentially damaging themselves and or damaging or obstructing the well. Furthermore, this type of failures can cause severe damage to equipment and personnel on the surface installation of the well, due to the violent movement of the affected components, the fall of equipment into the well and/or lashings caused by the rapid movement of cables from the elevation and descent system.

After such an accident has occurred, recovery operations are required, often with specialized equipment, to recover the equipment and pipes which may have fallen towards the bottom of the well, which are expensive and completely halt production or intervention work on said well. These types of operations are known in the art as fishing.

As a way of minimizing the damage and losses produced by these types of accidents and to further prevent the need to carry out fishing operations in wells, numerous security devices to be installed on a wellhead of an oil well have been proposed, meant to stop the fall of components into the well upon an eventual accident of this type.

One of such proposed devices is described in U.S. Pat. No. 3,467,224 A, of Contractors Services Inc., from 1969. Said patent describes an automatically activated pneumatic security device for securing a cable upon a cut of the cable of the travelling block outside the well. Said device is adapted only for securing cables and cannot be used to secure a string of pipes.

Another of such proposed devices is described in U.S. Pat. No. 4,372,706 A, of Exxon Production Research Co., from 1983. Said patent describes an automatically activated security device for securing a cable upon a cut of the cable of the travelling block outside the well. The described device, upon an accident, is automatically activated by means of the breakage of securing bolts. Said device is adapted only for securing cables and cannot be used to secure a string of pipes. Furthermore, since its activation requires the breakage of elements by the force of the cable and equipment during the fall, the device does not possess manual activation, and the securing bolts must be replaced after each activation.

It should be noted that all the above mentioned devices known in the art require, prior to their installation, the complete halt of all intervention activities and the total removal of all hanging elements in the well, either a string of pipes and/or cables for intervention equipment, which generates a substantial economic loss and loss of production and/or intervention time. Additionally, said devices, while designed to catch and secure a cable upon an accident, are not capable of carrying out additional functions, such as at least partially catching and securing a string of pipes. Another unfavorable aspect present in the devices known in the art is that the securing mechanisms commonly used are not equipped to catch and/or secure cables, pipes, intervention elements and/or combinations thereof which present irregular or non-circular cross-sections, since the securing elements, wedges or clamps are activated and moved simultaneously.

BRIEF DESCRIPTION OF THE INVENTION

There exists a need for cable-catcher security device capable of securing both cables and, at least partially, a string of pipes, but which in turn may be easily added to or removed from a wellhead while the same is in operation, without the need for removing elements and hanging strings of pipes from the well.

The cable-catcher device of the present invention is a device capable of securing a string of pipes, cables or other hanging equipment inside the well in the event of an accident on the surface which would cause the fall of those elements into the well. The design of the cable-catcher device of the present invention is such that it allows the same to be installed in a wellhead over a BOP without the need to remove the string of pipes, cables or other hanging equipment used in the operation and/or exploitation of the well. This has the benefit of greater ease and less time required for its installation or removal in a well which is in operation. This presents a great advantage over the cable-catcher devices known in the art, which must be installed prior to carrying out well operations, and requires complete removal of the equipment and/or strings of pipes hanging inside the well for their installation, change or removal.

Therefore, the object of the present invention is a device for securing and catching a cable in an oil well, the device comprising:

a. an upper horizontal plate and a lower horizontal plate, vertically aligned, each comprising a circular central orifice for the passing of a string of pipes and/or cable, and a cutout on the front part thereof, located between its front edge and said circular orifice;

b. lateral support means, located between the upper and lower plates, connecting said plates together, delimiting an aperture on the front part of the device, said aperture together with said cutouts of the upper and lower plates forming a front passage to the inside of the device;

c. at least two clamps driven by corresponding hydraulic cylinders, which are arranged at an acute angle with the vertical axis of the device; and d. a movable vertical plate arranged on the front part of the device between said side support means, pivotally connected by one of its sides to said upper and lower plates, wherein the movable vertical plate, in a first position, allows for the horizontal passing of a string of pipes and or cables through the front passage to a location at the center of the device, and in a second position, said movable vertical plate blocks said front passage, and wherein in a first position said clamps allow for vertical movement of a string of pipes and/or cables, and in a second position said clamps block the movement thereof.

In a preferred embodiment, the device comprises two clamps driven by corresponding hydraulic cylinders, located at opposed sides of device.

In a more preferred embodiment, the hydraulic cylinders are actuated by a manually activated means for providing hydraulic pressure.

In yet another preferred embodiment of the invention, the hydraulic cylinders may be activated independently from one another.

In a preferred embodiment of the invention, the lateral support means comprise a plurality of vertical plates.

In a more preferred embodiment of the invention, the angle of the hydraulic cylinders with the vertical axis is of approximately 30°, oriented to drive the clamps toward the bottom part of the device.

DETAILED DESCRIPTION OF THE INVENTION

Figure 1:
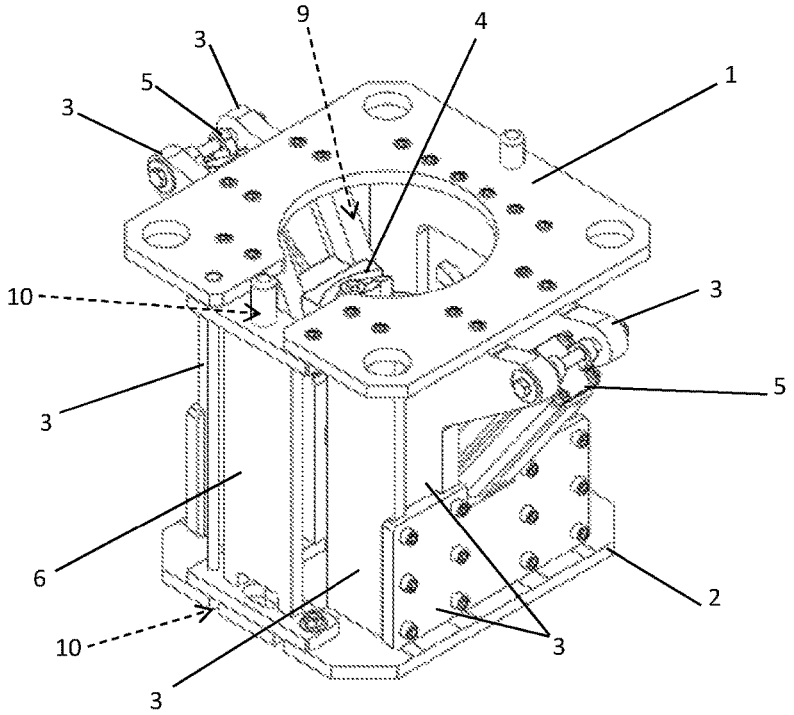
FIG. 1 is a perspective view of the device of the present invention, with its movable plate in closed position.

The present invention will now be described in detail with reference to FIGS. 1 to 8 which show a preferred embodiment, as an example and non-limiting the nature of the invention.

The cable-catcher device of the present invention comprises a rigid body comprised of an upper horizontal plate (1), a lower horizontal plate (2) and vertical lateral support means (3).

Said lateral support means (3) may comprise a plurality of cylindrical bars or bars with a square or rectangular profile. In a preferred embodiment, said lateral support means (3) comprise a plurality of vertical plates.

The upper (1) and lower (2) horizontal plates preferably comprise a circular orifice (9) on their center, thus defining a vertical passage with a diameter such that it allows for free movement of a string of pipes (7), cables (8) and/or well intervention equipment (not shown), such as the cables for an electrical submersible pump (ESP) (not shown), through it.

The upper (1) and lower (2) plates further comprise a cutout or region of removed material (10) which extends from one edge thereof, herein referred to as the front edge, towards said circular orifice (9). Said a cutouts or regions of removed material (10) in the upper (1) and lower (2) plates are vertically aligned to one another. Furthermore, the lateral support means (3) in the front side of the device delimit a vertical opening (11) which spans the entire height of the device and matches said cutouts or regions of removed material (10) of the upper (1) and lower (2) plates, thereby forming a communication or horizontal passage between the exterior of the device and the interior thereof.

This way, the body of the device comprises a vertical passing-through central orifice (9), in which a string of pipes (7), intervention equipment and/or feed cables (8) can move, and said vertical passing-through central orifice (9) is also horizontally connected to the exterior of the device by means of said passage or horizontal communication of the opening (11) which allows for rapid and simple installation or removal of the device in an oil well without the need for prior removal of the string of pipes (7) or cables (8).

The body of the device of the present invention further comprises a movable vertical plate (6), pivotally connected by one of its sides to the front part of the upper (1) and lower (2) plates. Said movable vertical plate (6), due to its pivotal connection, can adopt two positions. In a first position, the movable vertical plate (6) adopts a "closed" position as shown in FIG. 1, in which it obstructs or blocks the passage or horizontal communication opening (11) to the interior of the device. This "closed" position is the position used when the device is installed over the wellhead (not shown).

In a preferred embodiment of the present invention, the movable vertical plate (6) is secured in this closed position by means of suitable non-permanent fastening means (not shown).

Figure 2:
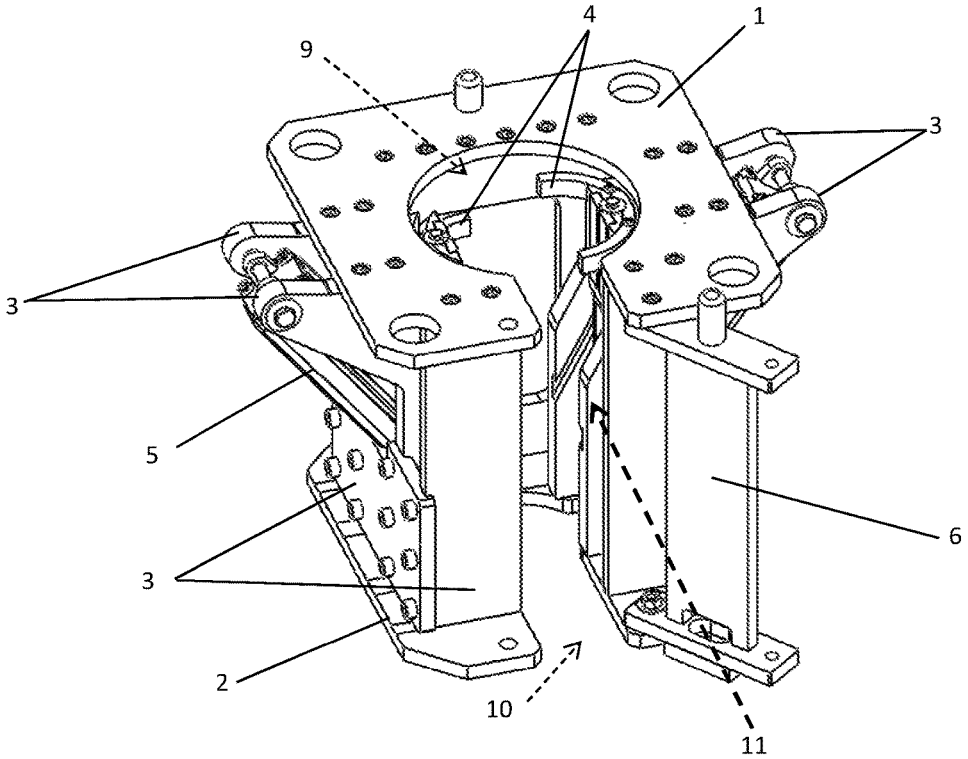
FIG. 2 is a perspective view of the device of the present invention, with its movable plate in open position
Figure 3:
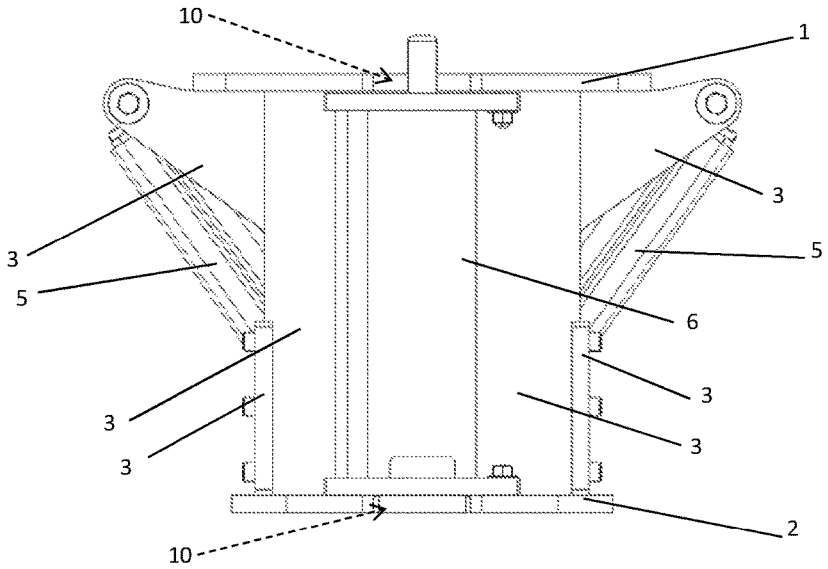
FIG. 3 is a front view of the device of the present invention.
Figure 4:
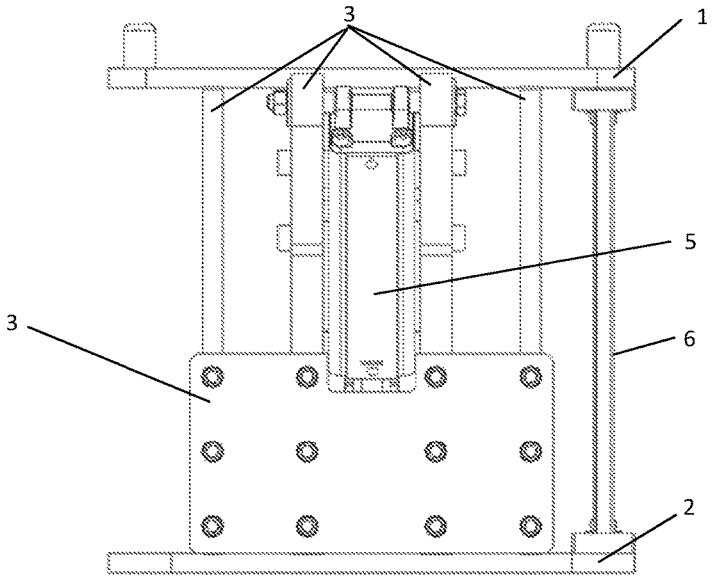
FIG. 4 is a side view of the device of the present invention.
Figure 5:
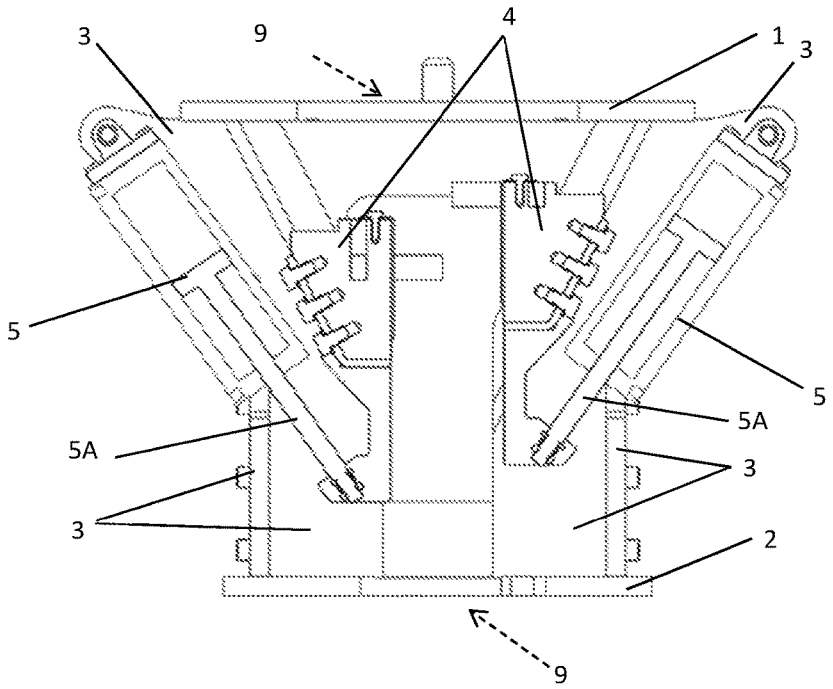
FIG. 5 is a front section view of the device of the present invention, with the clamps partially open.
Figure 6:
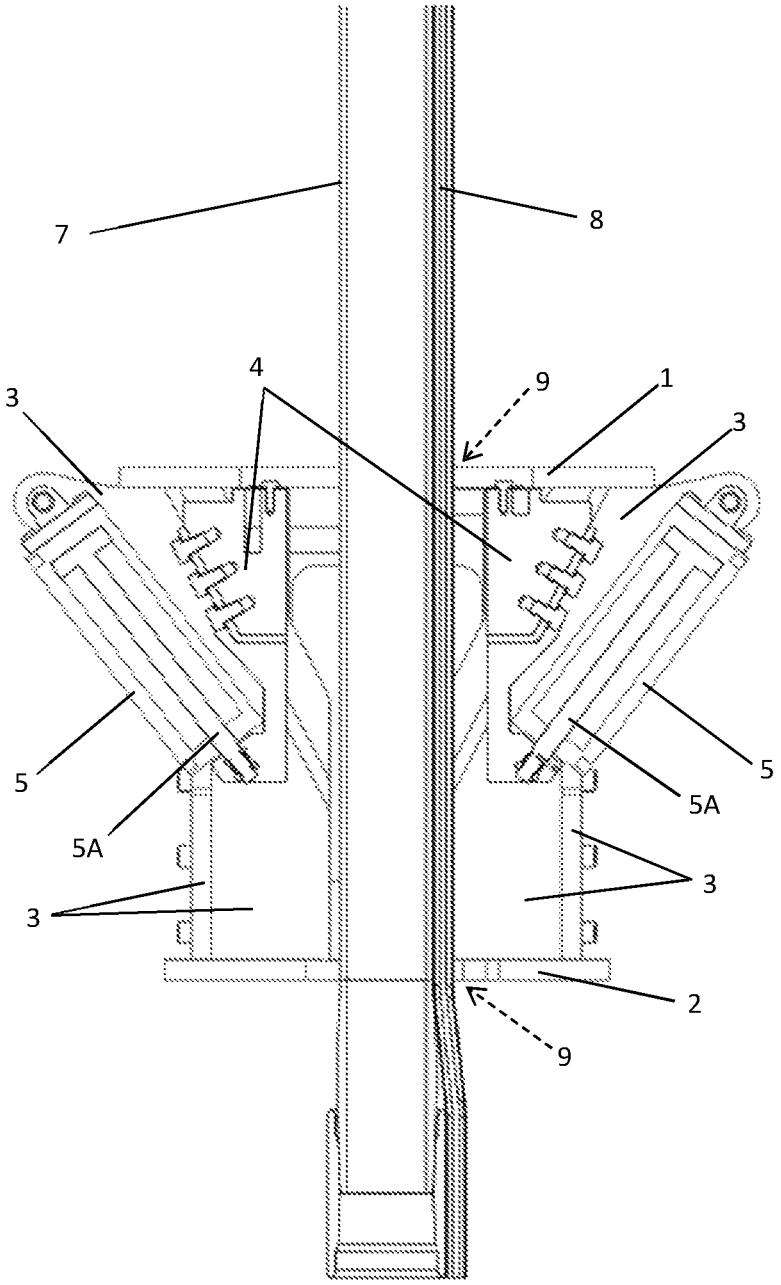
FIG. 6 is a front section view of the device of the present invention with a string of pipes inserted through it, with the clamps in open position.
Figure 7:
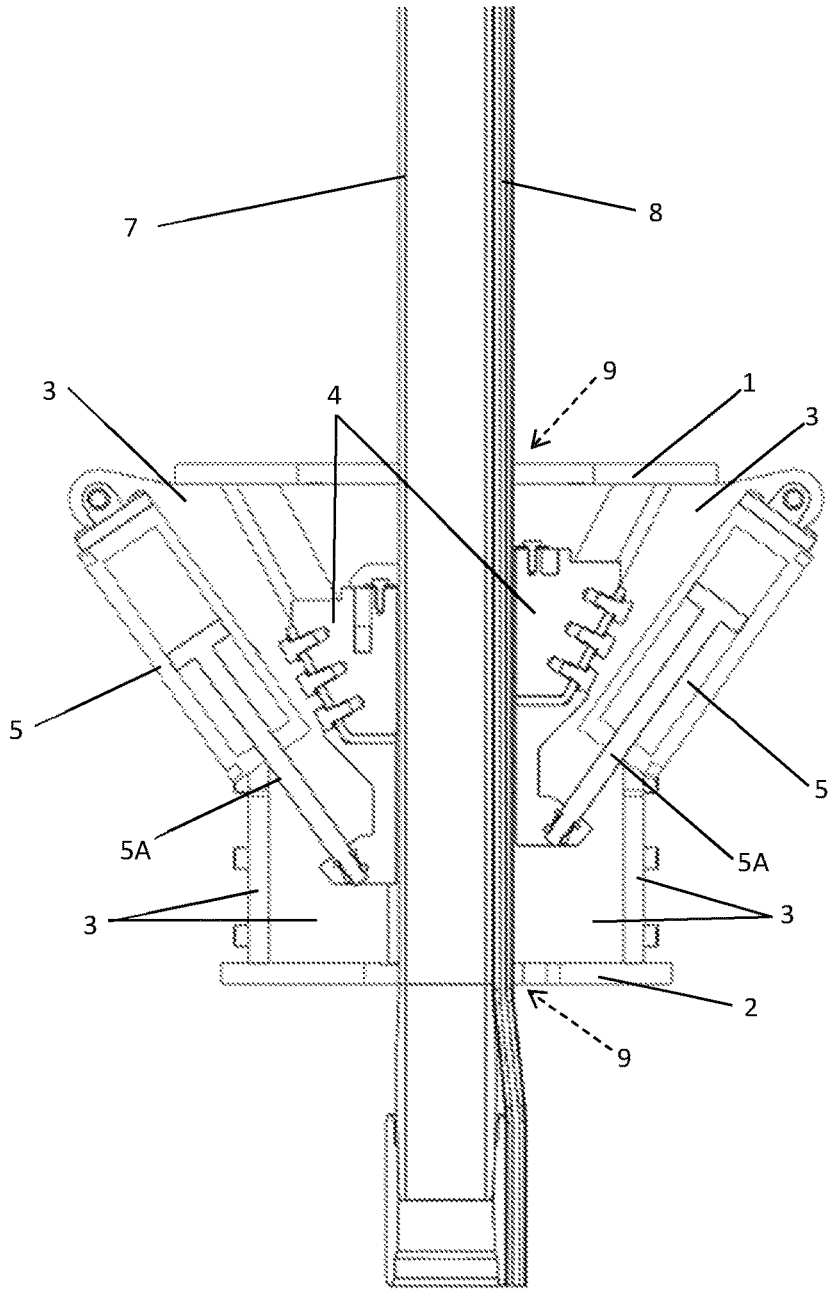
FIG. 7 is a front section view of the device of the present invention with a string of pipes inserted through it, with the clamps in closed position.
Figure 8:
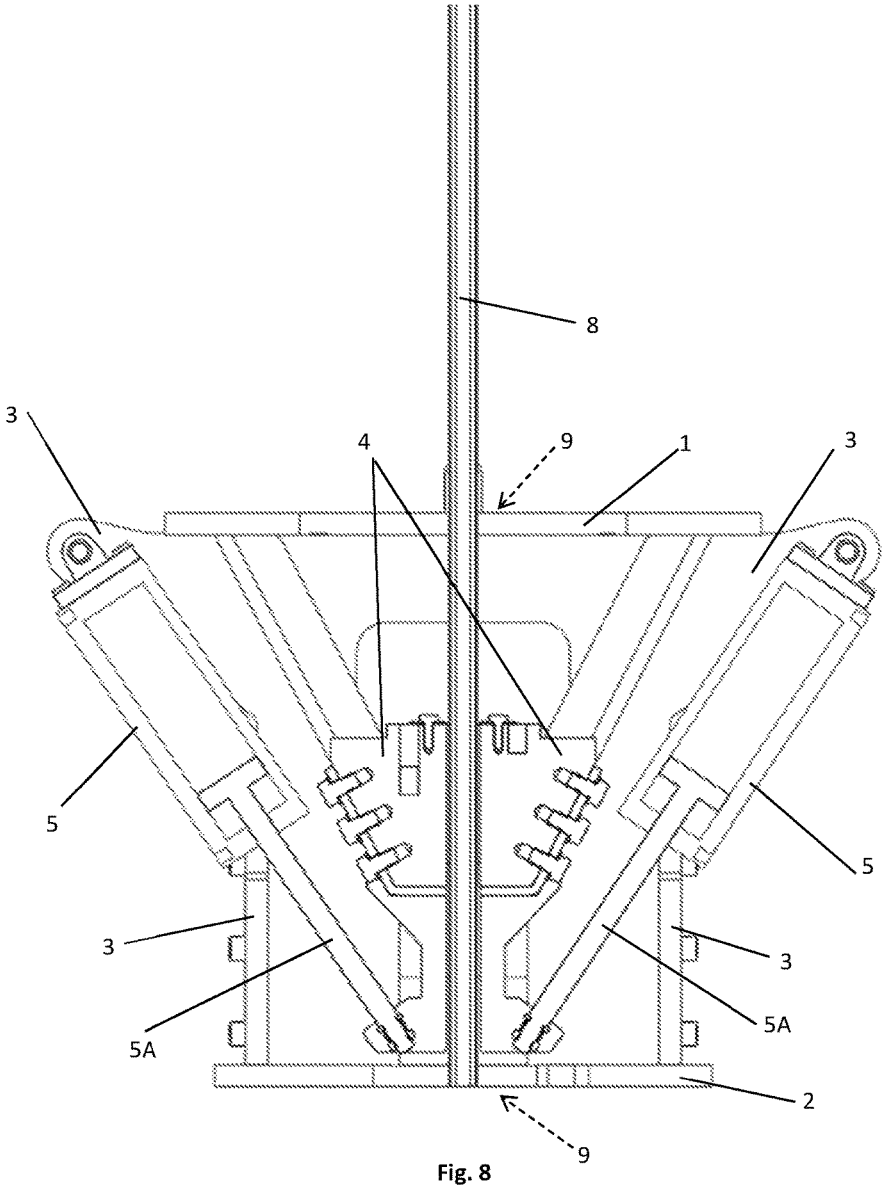
FIG. 8 is a front section view of the device of the present invention with a cable inserted through it, with the clamps in closed position.

In a second position, the movable vertical plate (6) adopts an "open" position as shown in FIG. 2, in which the same is rotated such it does not obstruct or block the passage or horizontal communication opening (11). This "open" position is the position used when the device is being installed by moving it horizontally, on a wellhead that is in operation.

In case installation of the device of the present invention over a well which is not operative is desired, that is to say without intervention equipment or strings of pipes hanging inside the well, the device of the present invention may be installed directly over the BOP without the need of using the movable vertical plate (6) in "open" position.

As it can be understood, the existence of this passage or horizontal communication opening (11) allows for the device to be placed over the wellhead, over the BOP, when the well is under intervention operations, with equipment or strings of pipes hanging within. This presents a considerable advantage over the devices known in the art, which require the removal of all hanging equipment and halt of operations prior to its installation, with consequent longer time out of operation and greater economic losses.

As it can be seen in FIGS. 5 to 8, the cable-catcher device of the present invention comprises a securing mechanism which comprises a plurality of clamps (4) driven by respective actuators, which in a preferred embodiment comprise hydraulic cylinders (5). Said clamps (4) have the capacity to secure or catch cables (8) and/or strings of pipes (7), either to support part of the weight of these elements during normal operation, or when these elements are in free-fall inside the well due to an accident.

In a preferred embodiment of the present invention, the hydraulic cylinders (5) that drive said clamps (4) are powered by a suitable means for providing hydraulic pressure (not shown), external to the device, such as one or more hydraulic pumps.

Two hydraulic cylinders (5) are rigidly connected to the body of the device, preferably to the lateral support means (3), and their movable rods (5A) are rigidly connected to respective clamps (4), thereby driving the movement thereof when actuating said hydraulic cylinders (5).

The clamps (4), by being connected to the rods (5A) of said hydraulic cylinders (5), are linearly moved from a first "open" position, away from the equipment, cables (8) or strings of pipes (7) that run through the device and a second "closed" position, in which the clamps (4) firmly secure or catch said equipment, cables (8), and/or strings of pipes (7) running through the device.

The direction of movement of the clamps (4) between said "open" and "closed" positions may be any suitable direction, as long as it does not obstruct the passing of equipment while in "open" position and adequately secures the same when in "closed" position. However, better securing results have been observed when the clamps (4) adopt a downward movement in a direction that forms an acute angle with the vertical axis, according to a preferred embodiment of the present invention.

In a more preferred embodiment of the present invention, the angle formed by the movement direction of the hydraulic cylinders (5) with the vertical axis is approximately 30°, preferably 27°.

In the "open" position of the clamps (4), the rods (5A) of the hydraulic cylinders (5) are in a retracted position, and the clamps (4) are away from the center of the device and in their most elevated position. When the device is activated so it adopts the "closed" position, the rods (5A) of the hydraulic cylinders (5) extend downward in a direction that forms an acute angle with the vertical axis, and the clamps (4) move until converging at the center of the device, in their lowermost position.

The movement of the clamps (4) may be equal and simultaneous for all of them, or they may move individually. This way, the device of the present invention may be used to secure with greater ease a string of pipes (7), cables (8) or a combination thereof which do not have a symmetrical or regular cross section. The activation of the means for providing hydraulic pressure, and consequently the actuation of the clamps (4) may be automatic or manual.

In a preferred embodiment of the present invention, the activation of the device is by manual operation. This allows for the device to be used for catching or securing a string of pipes (7) and/or intervention equipment cables (8) upon a failure, and that it also can be used to support, at least partially, the combined weight of an electrical submersible pump (ESP) and the string of pipes (7).

The invention claimed is:

1. A device for securing and catching a cable in an oil well, the device comprising:

a. an upper horizontal plate and a lower horizontal plate, vertically aligned, each comprising a circular central orifice for the passing of a string of pipes and/or cables, and a cutout on a front part of the device, located between a front edge and said circular orifice;

b. lateral support plates, located between the upper and lower plates, connecting said plates together, delimiting an aperture on the front part of the device, said aperture together with said cutouts of the upper and lower plates forming a front passage to a center of the device;

c. at least two clamps driven by corresponding hydraulic cylinders, which are arranged at an acute angle with the vertical axis of the device; and d. a movable vertical plate arranged on the front part of the device between said lateral support plates, pivotally connected by one side to said upper and lower plates, wherein the movable vertical plate, in a first position, allows for the horizontal passing of a string of pipes and/or cables through the front passage to a location at the center of the device, and in a second position, said movable vertical plate blocks said front passage, wherein in a first position said clamps allow for vertical movement of a string of pipes and/or cables, and in a second position said clamps block the movement thereof, and wherein the hydraulic cylinders are configured to be activated independently from one another to allow the clamps to move independently from one another.

2. The device according to claim 1, wherein the device comprises two clamps driven by corresponding hydraulic cylinders, located at opposed sides of the device.

3. The device according to claim 1, wherein the hydraulic cylinders are actuated by one or more manually activated hydraulic pumps for providing hydraulic pressure.

4. The device according to claim 1, wherein the lateral support plates comprise a plurality of vertical plates.

5. The device according to claim 1, wherein the angle of the hydraulic cylinders with the vertical axis is of approximately 30°, oriented to drive the clamps toward a bottom part of the device.

* * * * *